United States Patent [19]

Tagawa

[11] 4,351,603

[45] Sep. 28, 1982

[54] ELECTRONIC COPYING APPARATUS

[75] Inventor: Kazuaki Tagawa, Tokyo, Japan

[73] Assignee: Ricoh Company, Ltd., Tokyo, Japan

[21] Appl. No.: 204,364

[22] PCT Filed: Aug. 21, 1979

[86] PCT No.: PCT/JP79/00221

§ 371 Date: Apr. 23, 1980

§ 102(e) Date: Apr. 23, 1980

[87] PCT Pub. No.: WO80/00502

PCT Pub. Date: Mar. 20, 1980

[30] Foreign Application Priority Data

Aug. 28, 1978 [JP] Japan ..... 53-104728
Aug. 29, 1978 [JP] Japan ..... 53-105373

[51] Int. Cl.[3] ..... G03G 15/00

[52] U.S. Cl. ..... 355/3 CH; 250/324; 355/14 CH; 361/229

[58] Field of Search ..... 355/3 R, 3 CH, 3 TR, 355/14 CH, 14 TR; 361/229, 230; 250/324, 325, 326

[56] References Cited

U.S. PATENT DOCUMENTS

| | | | |
|---|---|---|---|
| 2,701,764 | 2/1955 | Carlson | 361/229 X |
| 2,836,725 | 5/1958 | Vyverberg | 250/326 |
| 3,339,069 | 8/1967 | Hayne et al. | 250/326 |
| 4,201,465 | 5/1980 | Oyama et al. | 355/3 CH X |
| 4,260,235 | 4/1981 | Stack | 355/3 CH |

*Primary Examiner*—Fred L. Braun
*Attorney, Agent, or Firm*—Wyatt, Gerber, Shoup, Scobey & Badie

[57] ABSTRACT

An electronic copying apparatus is provided of the type in which an electrostatic latent image is formed on a record medium and developed with a toner powder to provide a visual image which is then transferred onto a transfer paper. A neutralizer has a conductive shield plate which includes a side plate which is located at an advanced position as viewed in the direction of movement of the record medium and which is spaced a given distance from the surface of the record medium, maintaining an electric field formed therebetween below 2 kV/cm. A conductive electrode plate is disposed close to an image carrier or a record medium which moves while retaining the visual toner powder image, and a voltage of the same polarity as that of the toner powder is applied to the conductive electrode plate.

5 Claims, 11 Drawing Figures

ELECTRONIC COPYING APPARATUS

TECHNICAL FIELD

This invention relates to an electronic copying apparatus, and more particularly, to an electronic copying apparatus of the type in which an electrostatic latent image is formed on a record medium and then developed with a toner powder, and a visible image formed on the record medium as a result of the developing process is transferred onto a transfer member and subsequently the record medium is neutralized by utilizing a corona discharge.

BACKGROUND TECHNOLOGY

An electronic copying apparatus is known in the prior art which is of the type wherein an electrostatic latent image is formed on a record medium and developed with a toner powder to produce a visible image on the record medium, which visible image is then transferred onto a transfer member, and wherein the record medium is subsequently neutralized by utilizing a corona discharge. The record medium is in the form of a drum or belt which undergoes an angular movement to cause a cyclic movement of its peripheral surface during which the copying process takes place.

An electrostatic latent image may be formed through a series of charging and exposure steps for a record medium which comprises a photoconductive, light sensitive member, and, in one case, may be formed by a selective charging of the surface of the record medium with a recording electrode such as a multistylus for a record medium which comprises a dielectric material.

A problem encountered in an electronic copying apparatus of the type described is dispersion of the toner powder into the copying apparatus and a marring of a neutralizer by the toner powder. The problem will be considered in more detail with reference to the drawings.

FIG. 1 illustrates an example of an electronic copying apparatus of the type described. A record medium 1 which comprises a photoconductive, light sensitive member is in the form of a drum which is rotatable in a direction indicated by an arrow. During a copying operation, the peripheral surface of the record medium 1 which rotates in the direction of the arrow is uniformly charged by a corona discharge from a corona charger 2, and is then irradiated with a light image which is formed by an exposure optical system 3. An electrostatic latent image thus formed on the record medium 1 is then developed with a toner powder by means of a developer unit 4, and the resulting visible image is transferred on a transfer member or paper 8 by means of a transfer unit 5. The visible image which is transferred to the transfer paper 8 is fixed by utilizing a fixing unit, not shown. The transfer paper 8 carrying the fixed visible image is delivered externally of the apparatus, thus providing a single copy.

After transfer of the visible image, the record medium 1 is neutralized by a corona discharge from a neutralizer 6, and any residual toner is removed by a cleaning unit 7.

However, a problem arises in conjunction with the use of the neutralizer 6 in that a dispersion of the toner powder into the apparatus and a marring of the neutralizer 6 by the toner powder may result.

Specifically, after the transfer of the visible image, a quantity of non-transferred toner remains on the peripheral surface of the record medium as it moves toward the location of the neutralizer 6. A majority of such non-transferred toner is distributed in those areas of the peripheral surface of the record medium which have not been brought into contact with the transfer member during the transfer step. An increased quantity of toner may remain in such areas where the transfer paper 8 has an area less than that of the visible image formed on the peripheral surface of the record medium or where the copying process is practised while leaving an original receptacle open which causes a dense deposition of the toner in border areas on the record medium so as to frame the visible image corresponding to the original. Even during a normal copying operation, there exists a certain potential, and hence a quantity of toner, around an image region. Referring to FIG. 2 which illustrates a transfer step of a visible image, the non-transferred toner which remains on the marginal area of a record medium which is not brought into contact with the transfer paper is strongly influenced by a corona discharge from the transfer unit 5, and is strongly charged to the same polarity as the corona discharge. In FIG. 2, character T represents toner.

Referring to FIG. 3, there is shown the neutralizer 6 which comprises a corona discharge wire **6*a* which is surrounded by a conductive shield plate 6*b* having a rectangular cross section with its one side removed. The shield plate 6*b* has opposite side plates 2*a*, 2*b*, the free end of which are located close to the record medium 1 with a spacing of a similar length. An a.c. corona discharge voltage is applied to the wire 6*a*, the a.c. corona discharge of which eliminates any residual charge on the toner T and any remaining charge on the record medium 1. However, as mentioned previously, the residual toner T which reaches the neutralizing region defined by the neutralizer 6 may be strongly charged to a negative polarity as shown, for example, during the transfer step, so that as it approaches the neutralizing region, the charge on the toner T induces an electric charge of the opposite polarity in the edge region of one of the side plates of the neutralizer 6 which is located at an advanced position, as viewed in the direction of movement of the record medium 1, namely, the side plate 2*a*, which is positioned opposite to the record medium 1**, by an electrostatic induction.

The residual toner is charged to the same polarity as the peripheral surface of the record medium 1, and hence is subject to a force of repulsion from the peripheral surface, but is attracted to a potential of the opposite polarity on the conductive substrate of the record medium 1, whereby it is attached to the peripheral surface of the record medium 1 with a very reduced force and in an unstable manner. Then, if the charge is induced in the edge region of the advanced side plate **2*a* of the neutralizer 6, an electrostatic attraction occurs anew between the edge region and the toner T, whereby part of the toner T is transferred to the side plate 2*a* under the action of the Coulomb force and the gradient of electrical field. This causes a marring of the neutralizer 6** by the toner powder.

In addition, when the record medium is to be neutralized, the rotation thereof creates an air stream therearound, which causes a dispersion of part of the toner which is travelling from the peripheral surface of the record medium to the edge region into the various parts of the apparatus. The air stream and the centrifugal-force caused by the rotation of the record medium are a direct cause of dispersion of the toner T from the peripheral surface of the record medium.

The above description has been directed to the residual toner which remains after the completion of the transfer step, but the dispersion of the toner powder also occurs before the transfer step. Specifically, when an electrostatic latent image is being developed, a visible image is formed on the record medium by the use of the toner powder. Since some particles of the toner which forms the visible image are deposited on the record medium with a reduced electrostatic attraction or with a reduced adsorption effect due to van der Waals' force, when the air stream and the centrifugal force mentioned above are present, these toner particles readily loosen from the peripheral surface of the record medium to be dispersed into the apparatus.

A marring of the neutralizer 6 causes a change in the electrical parameters, which make it difficult to achieve a normal neutralizing effect. A dispersion of the toner into the apparatus causes a marring of other components, detracting from their normal functioning. Also, part of the dispersed toner may be deposited on the copy to degrade the image quality. In extreme cases, it may be driven out of the apparatus to cause a marring of the surrounding environment.

It will be noted that after the neutralizing step, there occurs no marring of the other side plate **2*b*** by the toner since both the record medium and the toner are substantially neutralized.

In the prior art there has been no remedy to prevent a marring of the neutralizer by the toner powder. Usually, the neutralizer is allowed to be marred, and is sometimes cleaned.

There has been a proposal to provide a cover around the peripheral surface of the record medium in order to prevent a dispersion of the toner. However, a deposition of the toner on the internal surface of the cover as a result of its dispersion produces a gradual accumulation thereon, which must be removed at suitable intervals, in the same manner as the neutralizer is periodically cleaned.

It is an object of the invention, first, to provide an electronic copying apparatus capable of preventing a marring of a neutralizer and of effectively preventing a dispersion of a toner powder which may arise in connection with the operation of the neutralizer, and secondly, to provide an electronic copying apparatus capable of effectively preventing a dispersion of a toner powder before the transfer of a visible image.

SUMMARY OF THE INVENTION

In an electronic copying apparatus according to the invention, a marring of a neutralizer and a dispersion of a toner which is caused by the neutralizer are prevented by a sophisticated configuration of a shield plate associated with the neutralizer, and/or by providing a reduced potential gradient between a record medium and a side plate of the shield plate which is located at an advanced position. A dispersion of the toner which results from the centrifugal force or air stream produced by a rotation of the record medium is effectively prevented by providing a conductive electrode plate which is disposed adjacent the record medium or transfer unit and to which a voltage of the same polarity as the toner is applied.

Specifically, the spacing between one of the side plates of the shield plate which is located at an advanced position as viewed in the direction of movement of the record medium (hereinafter referred to as a "front side plate") and the record medium is chosen to be greater than a given value so that the electric field established between the free end of the front side plate and the record medium does not exceed 2 kV/cm, preferably 1 kV/cm, thereby effectively preventing a deposition of the toner on the neutralizer and a dispersion of the toner which is caused by the neutralizer. In addition, a conductive electrode plate to which a voltage of the same polarity as the toner is applied is located adjacent an area of the peripheral surface of the record medium which carries the toner and also adjacent the transfer unit, thereby effectively preventing a dispersion of the toner powder which is attributable to the air stream and the centrifugal force.

BEST MODE FOR CARRYING OUT THE INVENTION

Embodiments of the invention will now be described below with reference to the drawings.

Figure 1:
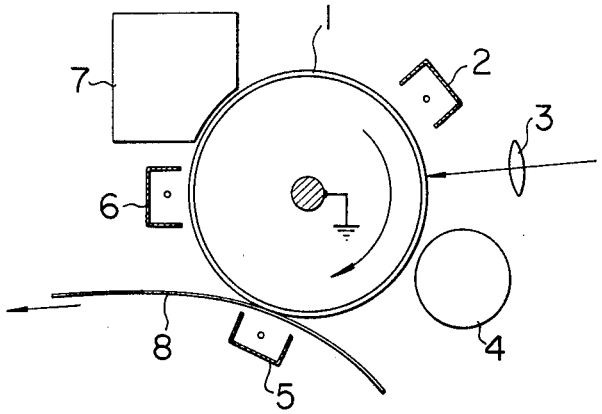
FIG. 1 is a front view of essential parts for illustrating an electronic copying apparatus which is to be improved by practising the invention.
Figure 2:
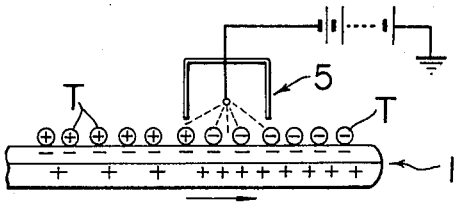
FIGS. 2 and 3 are schematic views for illustrating technical problems which are to be solved by the present invention.
Figure 3:
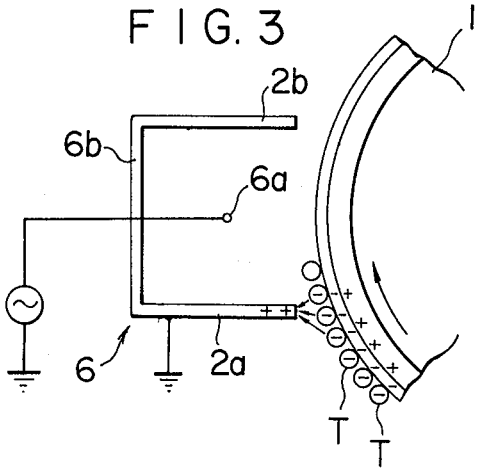
Figure 4:
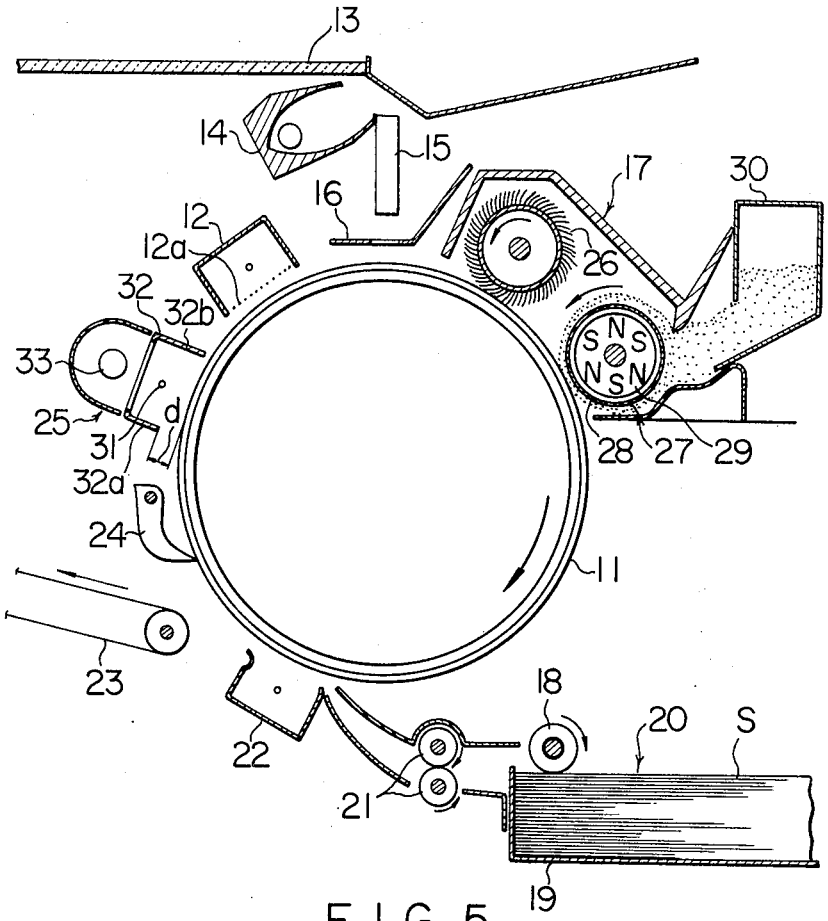
FIG. 4 is a front view of only essential parts of one embodiment of the invention.

FIG. 4 shows an embodiment of the invention, and a character 11 represents a photosensitive drum acting as a record medium which is rotating in a direction indicated by an arrow. An organic photoconductor is used as a photosensitive material, but it is to be understood that zinc oxide, selenium, cadmium sulfide and other materials may also be used. Disposed around the photosensitive drum 11 are a charger 12, a movable original receptacle 13, an illumination unit 14, a focusing light transmitter assembly 15, a slit member 16, a developing and cleaning unit 17, a paper feeder 20 comprising a feed roller 18 and a cassette 19, a pair of registering rollers 21, a transfer unit 22, a conveyor belt 23, separation claws 24 and a neutralizer 25. A Scorotron charger having a grid **12*a* which produces a uniform charging is used as the charger 12, thus charging the photosensitive drum to a uniform potential of −700 V. The developing and cleaning unit 17 includes a counterclockwise rotating brush roller 26 and a magnetic brush roller 27. The magnetic brush roller 27 comprises a non-magnetic sleeve 28 which is adapted to rotate counterclockwise, and a magnet roller 29 which is fixedly disposed within the sleeve 28 and having a series of alternating N- and S-poles. A toner container 30 which contains a quantity of one-component developer, which comprises a magnetic toner alone, is detachably mounted on the unit 17. The magnetic toner comprises a resin, iron powder and pigment, and has a volume resistivity equal to or greater than $10^8$ ohm-cm. The neutralizer 25 comprises a discharge electrode 31 which produces a corona discharge, a conductive shield plate 32 which is connected to ground, and a light 33 which emits light for purpose of eliminating electric charges. The light 33 is located rearwardly of the discharge electrode 31**, whereby the neutralizing process takes place by means of both the corona discharge and the exposure to light.

The operation of the electrophotographic copying apparatus of FIG. 4 will now be described. When a print button, not shown, is depressed, the photosensitive drum 11 is set in motion, and simultaneously the neutralizer 25 and the charger 12 are activated. After the electric charge is removed by the neutralizer 25, the drum 11 is charged to −700 V by the charger 12. The illumination unit 14 is then energized to illuminate an original on the receptacle 13 as it moves to the right, as viewed in FIG. 4. The focusing light transmitter assembly 15 projects the resulting light image onto the drum 11. After having travelled a given stroke to the right, the receptacle then moves in the opposite direction to return to its original position. During the return motion of the receptacle 13, the illumination unit 14 is deenergized. As a result of the exposure, an electrostatic latent image which corresponds to the original is formed on the surface of the drum 11, and is then converted into a visual image by the developing and cleaning unit 17. During a first revolution of the drum 11, the unit 17 operates as a developing unit. Hence, the brush roller 26 remains ineffective. A magnetic toner on the magnetic brush roller 27 is charged to the opposite polarity from that of the latent image by the action of electrostatic induction by the charge threof as well as by dielectric polarization, and the resulting electrostatic interaction causes the magnetic powder to be attracted to and deposited on the drum 11 against the magnetic influence of the magnetic roller 29. A stack of transfer papers S is maintained in the cassette 19, and an uppermost one of the transfer papers in the stack is fed forward by the feed roller 18, and is then fed into the clearance between the transfer unit 22 and the drum 11 in timed relationship with the movement of the latter as determined by the registering rollers 21. A high d.c. voltage of −5.8 kV, thus of the same polarity as the charger 12, is applied to the transfer unit 22. A toner image formed on the drum 11 is transferred onto the transfer paper S by means of the unit 22. Subsequently, the transfer paper S is separated from the drum 11 by means of the separation claws 24, and then conveyed on the belt 23 to a fixing unit, not shown, where it is fixed and then delivered externally of the apparatus. This completes the first revolution of the drum 11, and then the second revolution is started. During the second revolution, the charger 12, the illumination unit 14, the paper feeder 20 and the transfer unit 22 remain inoperative. Any residual toner powder and any residual charge on the drum 11 which remain after the transfer step is subjected to an irradiation and an a.c. corona discharge by the neutralizer 25, whereby the charge is removed. Subsequently, the brush roller 26 is driven for oscillating motion in order to displace the toner particles from their original positions. Obviously, the toner is partly removed by the brush roller 26, but the purpose of the brush roller 26 is to act as an auxiliary toner cleaning unit, and is not relied upon to remove the entire residual toner. The residual toner particles which are neutralized and displaced are in a condition to be readily removed from the drum 11. Consequently, the magnetic brush roller 27 which operated as a developing unit during the first revolution of the drum 11 can be directly utilized as a cleaning unit, without any change thereof. The magnetic toner which remains on the drum 11 can be removed therefrom by the mechanical brushing action and the magnetic attraction applied by the brush roller 27. In this manner, the second revolution of the drum 11 is completed, terminating one copying process. It is to be noted that one of the side plates, **32*a*, of the conductive shield plates 32 of the neutralizer 25 which is located at an advanced position as viewed in the direction of movement of the drum 11 is spaced from the drum 11 by a greater distance than the other side plate 32*b*. In the present embodiment, the front side plate 32*a* has a length which is shorter than the rear side plate 32*b*** by about 7 mm.

Figure 5:
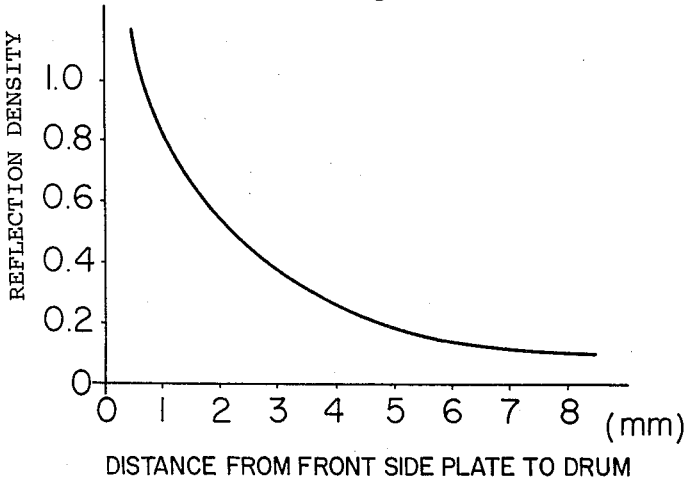
FIG. 5 is a graph illustrating the effect of the invention which is achieved by the embodiment shown in FIG. 4.

With continued reference to FIG. 4, an experiment has been conducted to examine the dispersion of the toner as a function of the distance d between the free end of the front side plate **32*a* and the drum 11. The results of the experiment are graphically shown in FIG. 5 where the abscissa represents the distance d in millimeters while the ordinate represents the reflection density of a white paper on which is applied a cello-tape to which the toner deposited on the shield plate 32 is transferred. As will be seen from FIG. 5, the deposition of the toner reduces as the distance of the side plate 32*a* from the drum 11 increases. However, it is found that the neutralizer current which flows to the drum 11** gradually increases as the distance d increases, with a progressive increase in a difference between the positive and the negative current value. At the distance of 8 mm, no influence is noted of an increased total current and the difference between the positive and the negative current value upon the image quality.

The experiment has been conducted by charging the drum 11 and developing the entire surface thereof without using an exposure. A number of copy processes have been conducted which correspond to 100 copies without supplying any transfer paper. Subsequently, the toner deposited on the shield plate 32 of the neutralizer 25 has been determined.

On the other hand, when the same experiment has been repeated with varying surface potential of the drum 11, it is found that the deposition of the toner onto the shield plate 32 is reduced when the electric field established between the drum surface and the grounded shield plate 32 does not exceed 2 kV/cm, and preferably 1 kV/cm.

While the described experiments have been conducted with one component toner as a developer, substantially similar results are obtained with a two component developer which comprises a non-magnetic toner and a magnetic carrier.

It is to be noted that the invention is equally applicable to a neutralizer for a copying apparatus of the type which utilizes a dielectric material rather than a photosensitive material for the record member which carries an electrostatic latent image and in which an electrostatic latent image is directly formed by a recording electrode such as a multi-stylus or the like. Also, the invention is applicable to a copying machine of the type which provides a single copy during one revolution of a conventional drum.

Figure 6:
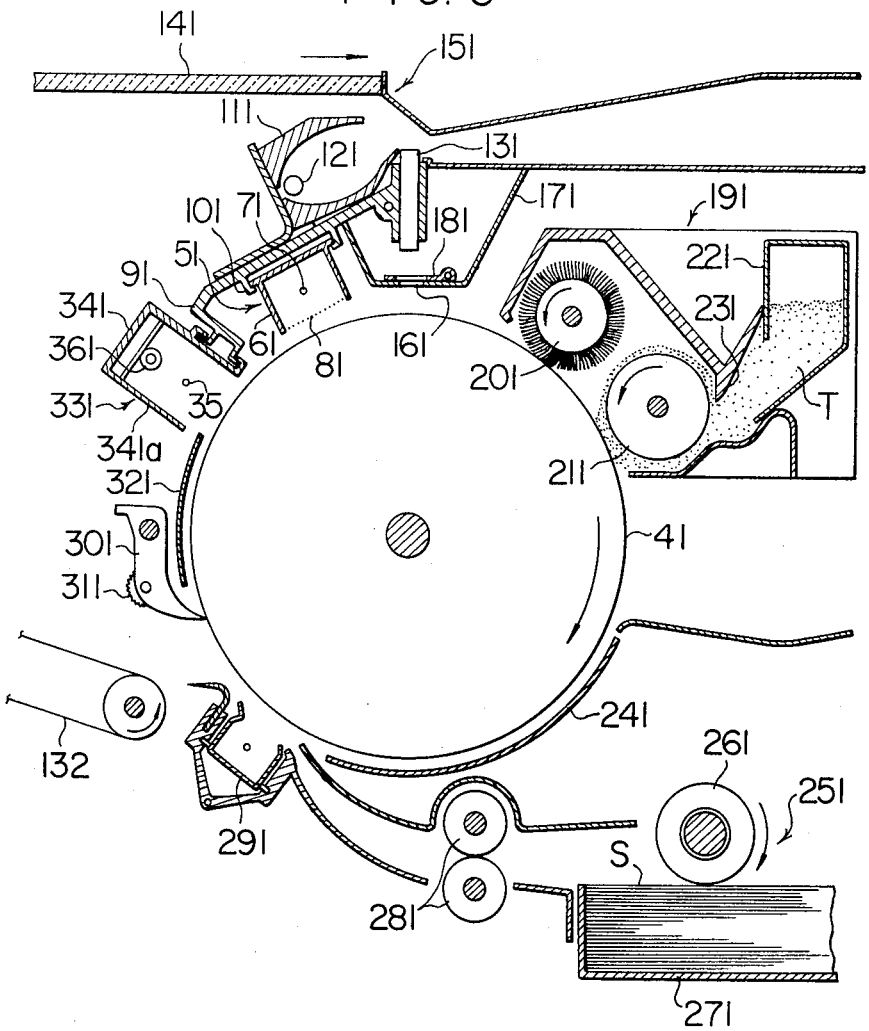
FIG. 6 is a front view of only essential parts of another embodiment of the invention.

FIG. 6 is a cross section of an electrophotographic copying apparatus according to another embodiment of the invention. In FIG. 6, a record medium comprises a drum of a photosensitive material which is rotatable in a direction indicated by an arrow. The drum 41 comprises a conductive support formed of a material such as aluminium which is connected to ground, and an overlying photoconductive layer. While an organic photoconductor material is used for the photoconductive material, it may be replaced by other materials such as zinc oxide, selenium, cadmium sulfide or the like. A Scorotron charger is used for a charger 51, and includes a shield casing 61 which is box-shaped to leave an open side which is directed toward the drum and which is connected to ground, a corona discharge electrode 71 disposed inside the casing 61 and extending axially of the drum, and a plurality of grid wires 81 extending across the open side of the casing 61 in parallel relationship with the discharge electrode, these wires serving to control the charging process. The casing 61 is freely accessible into or out of a guide groove 101 formed in a support member 91, on the outer surface of which a reflecting mirror 111 and an illumination light 121 are mounted. A focusing light transmitter assembly 131 (SELFOC optical system) is mounted on the upper end of the support member 91.

A slider 151 carrying a transparent glass pane 141 is disposed above the light transmitter assembly 131 so as to be movable in the lateral direction, as indicated by an arrow. A light shield 171 is disposed between the bottom of the light transmitter assembly 131 and the drum 41, and is formed with a slit 161. A shutter 181 is mounted to be movable thereon so as to open or close the slit 161. Adjacent the exposure station described, a developing and cleaning unit 191 is disposed. The unit 191 includes a brush roller 201 which is rotatable in the counterclockwise direction and which is provided with a number of brushes on its surface. The unit 191 is provided with means which move the brush roller 201 into contact with or away from the drum 41. A developing roller 211 which is formed with a magnetic brush on its surface is located adjacent the brush roller 201, and comprises a non-magnetic sleeve which is counterclockwise rotatable, and a magnet disposed within the sleeve and carrying a plurality of alternating N- and S-poles. A toner container 221 is detachably mounted on the unit 191 to the right of the developing roller 211, with its outlet directed downward. The container 221 contains a quanitity of one component magnetic toner T (hereinafter referred to simply as a toner) having a volume resistivity on the order ot $10^6$–$10^{12}$ ohm-cm.

The toner supplied from the container 221 is attracted to the developing roller 211 under the action of the magnetic attraction of the magnet which is disposed within the roller 211, and forms a magnetic brush of a uniform thickness on the surface thereof, which surface is controlled by a doctor blade 231. It is to be noted that the developing and cleaning unit 191 is detachable with respect to the remainder of the copying apparatus. A first electrode 241 which is arcuate in cross section is disposed adjacent to the drum 41 between the developing station and a transfer station to be described later. The purpose of the electrode 241 is to prevent a dispersion of the toner. It comprises a conductive material such as an aluminium sheet, and a voltage on the order of several hundred volts is applied thereto which is of the same polarity as the toner and of the opposite polarity from that of the latent image on the drum 41. A paper feeder 251 comprises a feed roller 261 which is driven for intermittent rotation in the clockwise direction, and a paper cassette 271 which contains a stack of transfer papers S. The roller 261 is adapted to feed an uppermost one of transfer papers in the stack one by one. It will be noted that registering rollers 281 are disposed in the path of transfer paper between the paper feeder 251 and the drum 41, and are controlled to rotate in synchronized relationship with the rotation of the drum 41. A high voltage which is sufficient to produce a corona discharge of the opposite polarity from that of the toner is applied to a transfer unit 291. Separating claws 301 are disposed adjacent the drum surface, and are arranged to move toward the drum 41 in timed relationship with the movment of the drum for separating the transfer paper S therefrom only when its leading end reaches the location of these claws. A spur wheel having an uneven peripheral surface is rotatably mounted on the lower end of the separating claw 301, and a belt conveyor 132 for conveying the separated transfer paper is disposed below the separating claws 301. The separating claws 301 are followed by a second electrode 321 which is disposed adjacent the drum 41 in order to prevent a dispersion of the toner. A voltage of the same polarity as the electrostatic image formed on the drum, or of the same polarity as the toner which is charged to this polarity by the transfer unit 291, is applied to the second electrode 321. A neutralizer 331 is detachably mounted on the support member 91 intermediate the second electrode 321 and the charger 51, and comprises a grounded conductive shield casing 341, and a corona discharge electrode 351 and a light 361 both of which are disposed inside the casing. An a.c. voltage is applied to the corona discharge electrode for effecting an a.c. corona discharge. The neutralizer 331 is adapted to effect irradiation by electromagnetic radiation from a light 361 and a corona discharge concurrently so as to remove any residual charge on the drum 41.

The shield casing 341 includes a front side plate **341*a* which is spaced more than a given spacing from the drum 41, in the same manner as mentioned previously, thus preventing any marring of the neutralizer 331 or a dispersion of the toner powder which is attributable to the operation of the neutralizer 331**.

Figure 7:
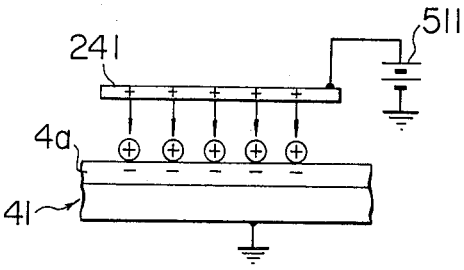
FIGS. 7, 8 and 9 are views and a graph which illustrate the effect of the invention achieved by the embodiment shown in FIG. 6.
Figure 8:
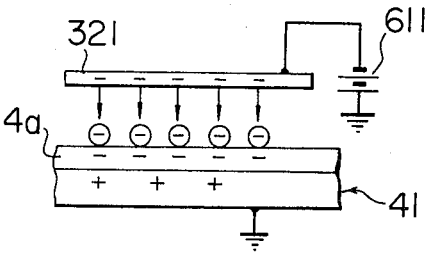

In operation, during a first revolution of the drum 41, it is uniformly charged to the negative polarity by the charger 51. The slider 151 moves to the right, while illuminating an original placed on the transparent glass pane 141 with light from the illumination light 121. Reflected light from the original is passed through the focusing light transmitter assembly 131 to be focused onto the drum. After passing over the exposure station, an electrostatic latent image which corresponds to the original is formed on the drum 41. The brush roller 201 remains spaced from the drum during the first revolution thereof while the magnetic brush on the developing roller 211 is brought into contact with the drum. During the developing process, the electrostatic latent image is converted into a visual image by a magnetic toner having a charge of the opposite polarity from that of the latent image. During the time an area on the drum 41 which carries the visual image moves toward the transfer unit 291, it moves in opposing relationship with the first electrode 241. The function of the first electrode 241 will be described with reference to FIG. 7. The drum 41 includes a photosensitive layer **4*a* on which an electrostatic latent image of a negative polarity is formed, and the magnetic toner of the opposite polarity is deposited on the surface thereof. A positive voltage, which is thus of the same polarity as the toner, is applied to the first electrode from a power source 511. Representing the charge of the toner by $q_1$ and the electric field produced by the electrode 241 by $E_1$, a force having a magnitude of $q_1 \times E_1$ acts to urge the toner against the drum surface, thus substantially eliminating any dispersion of the toner from the drum surface in the presence of any air stream. A transfer paper S is supplied from the paper cassette 271 by means of the feed roller 261, and the registering rollers 281 operate to deliver it to the transfer unit 291 in synchronized relationship with the movement of the drum 41. The transfer unit 291 acts to transfer the toner on the drum onto the transfer paper S in an electrostatic manner. When the transfer step is completed, the transfer paper is separated from the drum by means of the separating claws 301 and then conveyed by the conveyor belt 132 to a fixing unit, not shown, where the toner image is permanently fixed on the transfer paper S and then delivered externally of the apparatus. It will be appreciated that an electric charge remains on a region of the drum 41 where no image has been formed, and hence the toner is deposited during the developing step. Consequently, the toner which has been charged to the positive polarity before its passage through the transfer unit 291 is forcedly charged to the negative polarity by the transfer unit 291 since it is not brought into contact with the transfer paper S. Because such toner has the same polarity as that of the residual charge on the photosensitive layer 4***a* and hence is subject to a repulsion therefrom, it is easily dispersed. However, the second electrode 321 positively prevents a dispersion thereof. This will be readily understood by reference to FIG. 8. In FIG. 8, the toner is charged to the same polarity as any residual charge on the photosensitive layer 4*a*. A voltage of the same polarity as the toner is applied to the second electrode 321 from a power source 611. Hence, representing the charge of the toner by $q_2$ and the magnitude of an electric field produced by the electrode 321 by $E_2$, a force having a magnitude of $q_2 \times E_2$ acts to urge the toner against the drum surface. It should be understood that this force is greater in magnitude than the force of repulsion $q_2 \times E_3$ which is produced by the residual charge on the photosensitive layer 4*a*. In this manner, any residual toner and any non-transferred toner which remains on the drum 41 after the transfer step pass below the neutralizer 331 while their dispersion is prevented. The neutralizer 331 acts to reduce the toner charge and the residual charge on the drum 41 to substantially zero potential. This completes the first revolution of the drum 41. Then, the second revolution of the drum 41 is started, and during the second revolution, the charger 51, the light 121, the slider 151, the paper feeder 251 and the transfer unit 291 remain inoperative. Obviously, the transfer unit 291 remains operative during the initial phase of the second revolution since the transfer is not completed. The brush roller 201 is brought into contact with the drum 41 and rotates in a direction indicated by an arrow to have its charge removed, while removing any residual toner on the drum 41. It should be noted that the residual toner is not entirely removed by the brush roller 201, but that any toner which remains after passing below the brush 201 is subject to a rubbing action by the magnetic brush on the developing roller 211, whereby it is removed substantially completely by the magnetic attraction of the magnet. It will be noted that the brush roller 201 and the developing roller 211 are disposed in the same unit, and any toner deposited onto the brush of the brush roller 201 is removed by the action of a striking rod, not shown, to be collected on the developing roller 211. It should be noted that in the developing and cleaning unit 191, the developing action and the cleaning action by the developing roller 211 are automatically selected in accordance with the status of the charge on the drum 41 without effecting any electrical or mechanical switching operation.

When the second revolution of the drum 41 is terminated, the described operation is repeated if a continued copying operation is desired. However, it will be understood that a single copy is obtained by substantially two revolutions of the drum 41. When the final copy is obtained, the drum 41 continues to rotate through an additional one revolution for the purpose of cleaning and charge elimination before it is stopped.

The first and second electrodes 241, 321 may be formed of any conductive metal material. Alternatively, the surface of these electrodes which is located nearer the drum 41 may be treated to provide an insulation thereon which does not prevent an electric field from being produced which is sufficient to prevent the dispersion of the toner. The voltage applied to the first electrode should be chosen to avoid an adverse influence upon the electrostatic latent image on the drum surface.

The invention will now be illustrated by way of Examples.

EXAMPLE 1

In an electrophotographic copying apparatus as illustrated in FIG. 6, an organic photoconductor is uniformly charged to −700 V by means of the charger 51 and the shutter plate 181 is operated to avoid an exposure. Thereafter, the photoconductor is passed below the developing and cleaning unit 191, thus forming an overall black image. An aluminium plate is used for the first electrode 241 and spaced about 3 mm from the drum surface. 1,000 copies are obtained by applying voltages of 0 V and +700 V to the electrode 241, respectively. Subsequently, a quantity of toner which is deposited on the inner surface of the first electrode 241 is transferred onto a cello-tape, which is then transferred to a white paper (I.D. =0.07) for the determination of the density with a reflection densitometer. It is found that the reflection density is 0.3 for the applied voltage of 0 V, and is 0.1 for +700 V. This clearly demonstrates the effect of the invention in preventing a dispersion of the toner.

EXAMPLE 2

Figure 9:
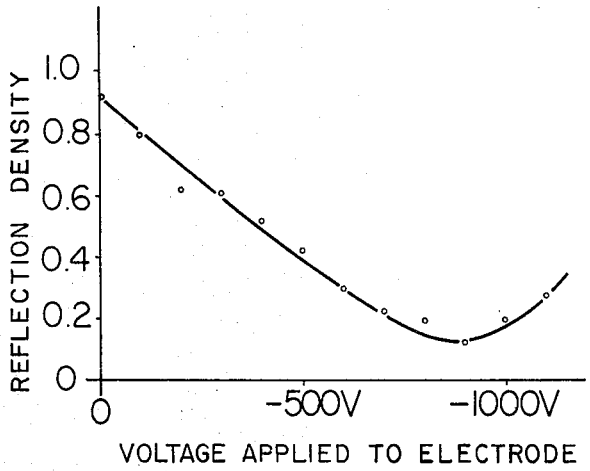

An electrophotographic copying apparatus as illustrated in FIG. 6 is used. An organic photoconductor is uniformly charged −700 V by means of the charger 51, and the shutter plate 181 is operated to avoid an exposure. By passing below the developing and cleaning unit 191, an overall black image is formed. Subsequently, a transfer paper of one-half the size of the black image (which may be A-4 size relative to the A-3 size of the image) is supplied from the paper feeder 251, and the toner on the drum 41 is transferred onto the transfer paper by the transfer unit 291 to which a voltage of −5.8 kV is applied. The second electrode 321 has a length, as measured in the direction of movement of the drum 41, of 10 mm, and is mounted at a spacing of about 2 mm from the drum surface. The voltage applied to the electrode 321 is changed from 0 to −1,100 V in increments of 100 V, producing 300 copies for each voltage level. A procedure which is similar to that used in the Example 1 is used to determine the reflection density of the toner which is deposited on the electrode 321. The results are graphically illustrated in FIG. 9. Specifically, the reflection density is 0.9 when no voltage is applied, while the reflection density reduces in magnitudue as the voltage level is gradually increased. In other words, the dispersion of the toner reduces with an increased voltage level, exhibiting a minimum value at the voltage level of −900 V. It is found that an increased dispersion of the toner occurs at voltage levels beyond −900 V. While the observed phenomenon is not fully understood, it is found that a voltage on the order of −900 may be applied to the electrode 321 for effectively preventing a dispersion of the toner.

Figure 10:
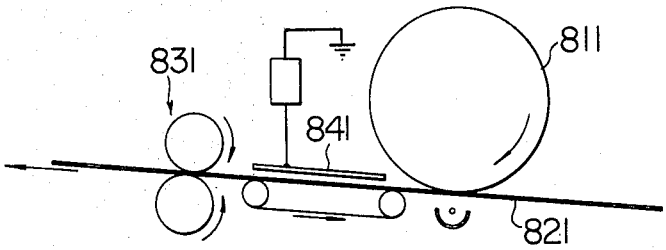
FIGS. 10 and 11 are views illustrating two modified embodiments which assist in enhancing the effect of the invention.
Figure 11:
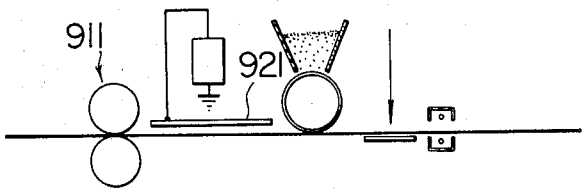

A modified arrangement may be used which employs an electrode to prevent a dispersion of the toner. By way of example, in an arrangement shown in FIG. 10, an electrode 841 to prevent a dispersion of the toner is disposed on a path of transfer paper 821 to which a toner image has been transferred from a drum 811, and extending to a fixing unit 831, with the electrode 841 being disposed in facing relationship with the image surface of the transfer paper 821. Alternatively, FIG. 11 illustrates the provision of an electrode 921 to prevent a dispersion of the toner, which electrode is disposed in facing relationship with the image surface of a zinc oxide paper as it moves on a path from charging, exposure and developing stations to a fixing unit 911.

It should be understood that the invention is equally applicable when an ordinary two component developer is used in place of the magnetic toner, with similar results.

What is claimed is:

1. In an apparatus comprising a record medium movable relative to a plurality of processing stations for forming images on a transfer medium, said stations including means for forming an electrostatic latent image on said record medium, a developing unit for developing the electrostatic latent image with a toner powder, a transfer unit including a corona discharger for transferring the developed image onto a transfer member, means including a neutralizer for removing any charge remaining on the surface of the record medium after transfer of the developed image from the record medium, and a cleaning unit for removing any non-transferred toner which may remain on the record medium, said neutralizer comprising a corona discharge wire and a grounded conductive shield plate having two side plates spaced in the direction of movement of said record medium relative to said shield plate, the improvement including means for limiting the electric field produced between the first of said side plates to encounter said record medium and said record medium to a value no greater than 2 kV/cm, said limiting means including spacing said first side plate to encounter said record medium a predetermined distance from said record medium.

2. An apparatus according to claim 1, further including means electrostatically urging toner powder carried by said record medium onto said record medium, said urging means including a conductive electrode plate disposed close to said record medium, and means applying a voltage of the same polarity as that of the toner powder to said conductive electrode plate.

3. An apparatus according to claim 1, said electric field being limited to a level no greater than 1 kV/cm.

4. An apparatus according to claim 2, said electric field being limited to a level no greater than 1 kV/cm.

5. An apparatus according to any of claims 1, 2, 3 or 4, said first side plate to encounter said record medium being about 7 mm shorter than said second side plate to encounter said record medium.

* * * * *